US010330092B2

(12) United States Patent
Kennedy Lageson et al.

(10) Patent No.: US 10,330,092 B2
(45) Date of Patent: Jun. 25, 2019

(54) BICYCLE TIRE PUMP

(71) Applicant: Everlast Climbing Industries, Inc., Chattanooga, TN (US)

(72) Inventors: Andrew Patrick Kennedy Lageson, Minneapolis, MN (US); Joel Greenblatt, Wauwatosa, WI (US)

(73) Assignee: Everlast Climbing Industries, Inc., Chattanooga, TN (US)

( * ) Notice: Subject to any disclaimer, the term of this patent is extended or adjusted under 35 U.S.C. 154(b) by 0 days.

(21) Appl. No.: 15/683,174

(22) Filed: Aug. 22, 2017

(65) Prior Publication Data

US 2017/0350378 A1 Dec. 7, 2017

Related U.S. Application Data

(63) Continuation of application No. 14/485,311, filed on Sep. 12, 2014, now Pat. No. 9,765,766.

(51) Int. Cl.
*F04B 33/00* (2006.01)
*F04B 39/12* (2006.01)

(52) U.S. Cl.
CPC ..... *F04B 33/005* (2013.01); *F04B 39/12* (2013.01)

(58) Field of Classification Search
CPC ..... F04B 33/00; F04B 33/005; F04B 9/14; F04B 39/12
See application file for complete search history.

(56) References Cited

U.S. PATENT DOCUMENTS

| | | | | |
|---|---|---|---|---|
| 1,253,976 | A | 1/1918 | Hughes | |
| 1,386,567 | A | 8/1921 | Hafstrom | |
| 1,414,463 | A | 5/1922 | Grant | |
| 1,476,600 | A * | 12/1923 | Dickens | F04B 33/005 417/521 |
| 1,501,546 | A | 7/1924 | Shaw | |
| 2,697,842 | A | 12/1954 | Meyer | |
| 3,907,461 | A | 9/1975 | Bouder | |
| 4,200,233 | A | 4/1980 | Mitchell | |
| 4,470,870 | A | 9/1984 | Driscoll et al. | |
| 7,367,366 | B2 | 5/2008 | Liao | |

(Continued)

OTHER PUBLICATIONS

Pages from http://www.bikefixtation.com/, 9 sheets, printed on Sep. 15, 2014.

(Continued)

*Primary Examiner* — Peter J Bertheaud
*Assistant Examiner* — Dnyanesh G Kasture
(74) *Attorney, Agent, or Firm* — McAndrews, Held & Malloy, Ltd

(57) ABSTRACT

A pump that includes a body having a base and a top portion, wherein the base is configured to be anchored to the ground and the top portion is detachably connected to an upper plate in the body. The pump includes a handle assembly including a piston rod, handle bar, and cap that are detachably connected to each other by a fastener. The pump includes a tube positioned in the body. The tube slidably receives the piston rod and is connected to an air line. A hose is connected to the air line and extends from the body. The hose has a head configured to engage the nozzle of a tire. When the piston rod is moved downward within the tube, air is displaced from the tube and through the air line to the hose such that the head dispenses air.

10 Claims, 10 Drawing Sheets

(56) References Cited

U.S. PATENT DOCUMENTS

| | | | |
|---|---|---|---|
| 7,469,591 | B1 | 12/2008 | Chuang |
| 2003/0026706 | A1 | 2/2003 | Wu |
| 2004/0258534 | A1 | 12/2004 | Patel |
| 2008/0050255 | A1 | 2/2008 | Chuang |
| 2009/0060766 | A1 | 3/2009 | Hawkins et al. |
| 2010/0180957 | A1 | 7/2010 | Wu |

OTHER PUBLICATIONS

Dero Air Kit A Brochure. 3 sheets. Believed to be publicly available no later than Sep. 2012.
Dero Air Kit B Brochure. 3 sheets. Believed to be publicly available no later than Sep. 2012.

* cited by examiner

BICYCLE TIRE PUMP

RELATED APPLICATION

This application is a Continuation of, and claims priority to, U.S. patent application Ser. No. 14/485,311, filed on Sep. 12, 2014. U.S. patent application Ser. No. 14/485,311 is incorporated herein by reference and made a part hereof.

FIELD OF EMBODIMENTS OF THE INVENTION

Embodiments of the present invention generally relate to air pumps, and, more particularly, to air pumps for inflating bicycle tires.

BACKGROUND

In order for a bicycle to operate effectively, the air pressure in the tires of the bicycle should be maintained at a certain level. Over time and over the course of use, bicycle tires leak air such that the air pressure in the tire decreases to an undesirable level. Therefore, bicycle users frequently need to refill the air in the tires of their bicycles with an air pump. Such bike pumps include a piston rod positioned in a tube body with a hose extending from the tube body. A handle is connected to the piston rod, and the hose has a head with a nozzle that is configured to engage the air valve on a bike tire. The bike user uses the handle to push the piston rod up and down in the tube body, and, as the piston rod moves down, the piston pushes air from the tube body through the hose to the hose nozzle. The hose nozzle delivers the air to the bike tire valve and inflates the bicycle tire with air.

While many bicyclists have their own portable bike pump which they keep at home or take with them on rides, "public" bicycle pumps exist that are configured to be secured to the ground outdoors along bike paths or at parks, bike stations, or shops so that many different bicyclists can use the pump.

Conventional bicycle pumps typically are lightweight and not made of particularly robust materials. The handle, piston rod, and tube body are typically made of plastic, and the hose is typically made of rubber. Therefore, bicycle pumps, especially public pumps mounted outdoors, can wear out and break quickly from use and the elements. For example, the bike pump handle often breaks easily, and the hose can easily be detached from the tube body or perforated. In addition, the hose is typically connected to the body of the pump by pressure fittings, so it is easy to detach from the pump. Moreover, because many of the parts of a conventional bicycle pump are integrally formed together as a single plastic piece, it is not easy to disassemble the bike pump or remove or replace individual parts of the bike pump. For example, the piston rod and the handle may be integrally formed as a single plastic piece, but if only the handle becomes damaged, both the piston rod and the handle need to be replaced. In fact, sometimes when an individual bike pump component does break or wear out, the whole pump must be replaced with a new pump because the component cannot be easily replaced.

SUMMARY OF EMBODIMENTS OF THE INVENTION

Certain embodiments of the present invention provide a pump for inflating tires with air. The pump includes a body having a base and a top portion. The base is configured to be anchored to the ground, and the top portion is detachably connected to an upper plate in the body by fasteners. The pump includes a handle assembly that includes a piston rod, handle bar, and cap that are detachably connected to each other by a fastener. The pump includes a tube positioned in the body and that extends through the upper plate. The tube slidably receives the piston rod and is connected to an air line. The pump includes a hose that is connected to the air line and that extends from the body. The hose has a head configured to engage the nozzle of a tire. When the piston rod is moved downward within the tube, air is displaced from the tube and through the air line to the hose such that the head dispenses air.

The pump may further include a pressure gauge that is threadably mounted to the upper plate and that is positioned beneath the top portion. The top portion includes a transparent portion positioned over the gauge. The gauge has a face and a cover that define a chamber therebetween, and oil is located in the chamber.

The air line may include (a) a first air line that is connected at a first end to a barbed fitting extending from the tube and that is connected at a second end to a check valve, and (2) a second air line that is connected at a first end to the check valve and that is connected at a second end to an adaptor connected to the hose.

The pump hose may be threadably connected to an adapter that is connected to the air line. The pump hose may be made in part of threaded metal.

The piston rod may include a piston head on which is mounted two flexible gaskets that each form a seal with an interior wall of the tube.

The pump handle assembly may include rubber grips that are slidably mounted to the handle bar.

The head of the hose may magnetically connect to the body.

Certain embodiments of the present invention provide a pump for inflating tires with air. The pump includes a body having a base and a top portion. The base has a hole configured to receive an anchor to secure the base to the ground, and the top portion is detachably connected to an upper plate in the body by fasteners. The pump includes a handle assembly including a piston rod, handle bar, and handle cap that are detachably connected to each other by a fastener. The pump includes a tube positioned in the body and extending through the upper plate. The tube slidably receives the piston rod and is connected to an air line. A hose is connected to the air line and extends from the body. The hose has a head configured to engage the nozzle of a tire. The pump includes a pressure gauge that is detachably mounted to the upper plate and positioned beneath the top portion. The pressure gauge is connected to the air line. When the piston rod is moved downward within the tube, air is displaced from the tube and through the air line to the hose such that the head dispenses air and the pressure gauge displays the pressure of the air in the air line.

Certain embodiments of the present invention provide a pump for inflating tires with air. The pump includes a body having an upper portion and a lower portion, wherein the lower portion includes a base plate that is configured to be secured to the ground by an anchor. The lower portion of the body has a greater outer diameter than the upper portion. The pump includes a handle assembly having a piston rod, handle bar, and handle cap that are detachably connected to each other by a fastener. The pump includes a tube positioned in the upper portion of the body. The tube is slidably received in the piston rod. The pump includes an air line positioned in the lower portion of the body. The air line is connected to the tube at one end and connected to an adapter at another end. The pump includes a hose that is connected to the adapter and that extends from the lower portion of the body. The hose has a head configured to engage the nozzle of a tire. When the piston rod is moved downward within the tube, air is displaced from the tube and through the air line to the hose such that the head dispenses air.

Figure 1:
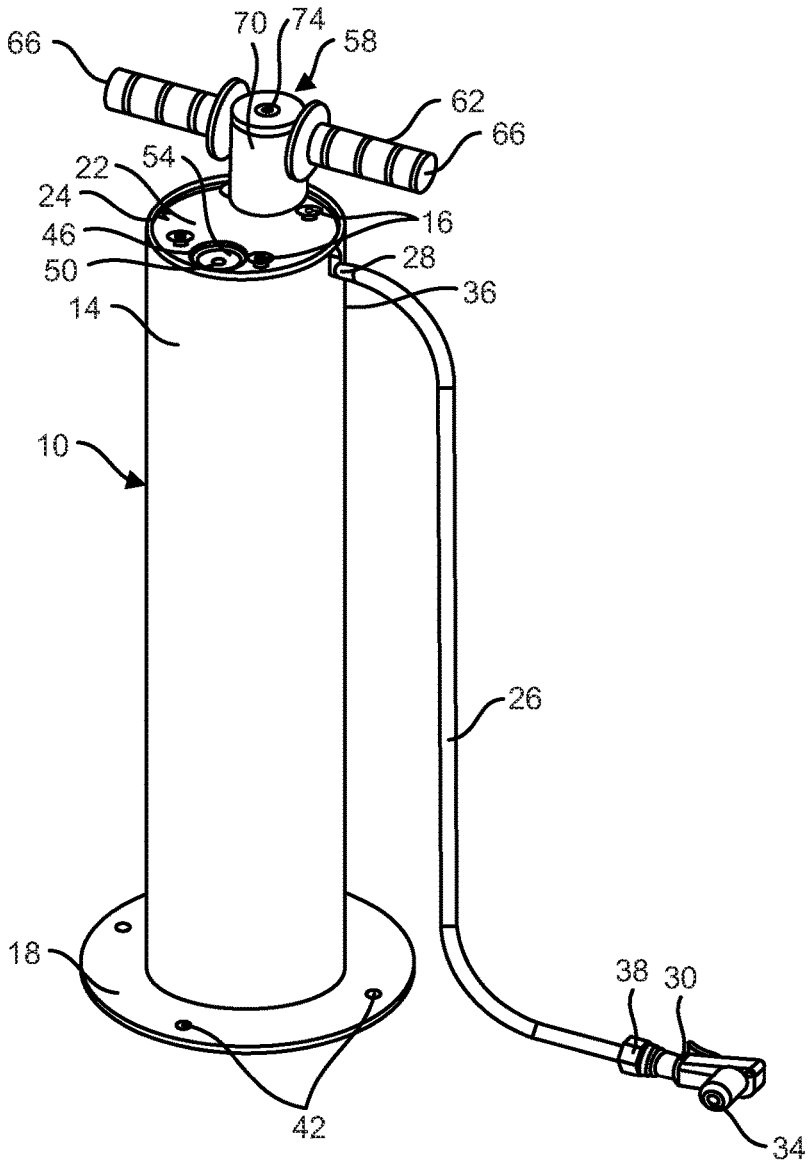
FIG. 1 illustrates an isometric view of a pump according to an embodiment of the invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE INVENTION

Figure 2:
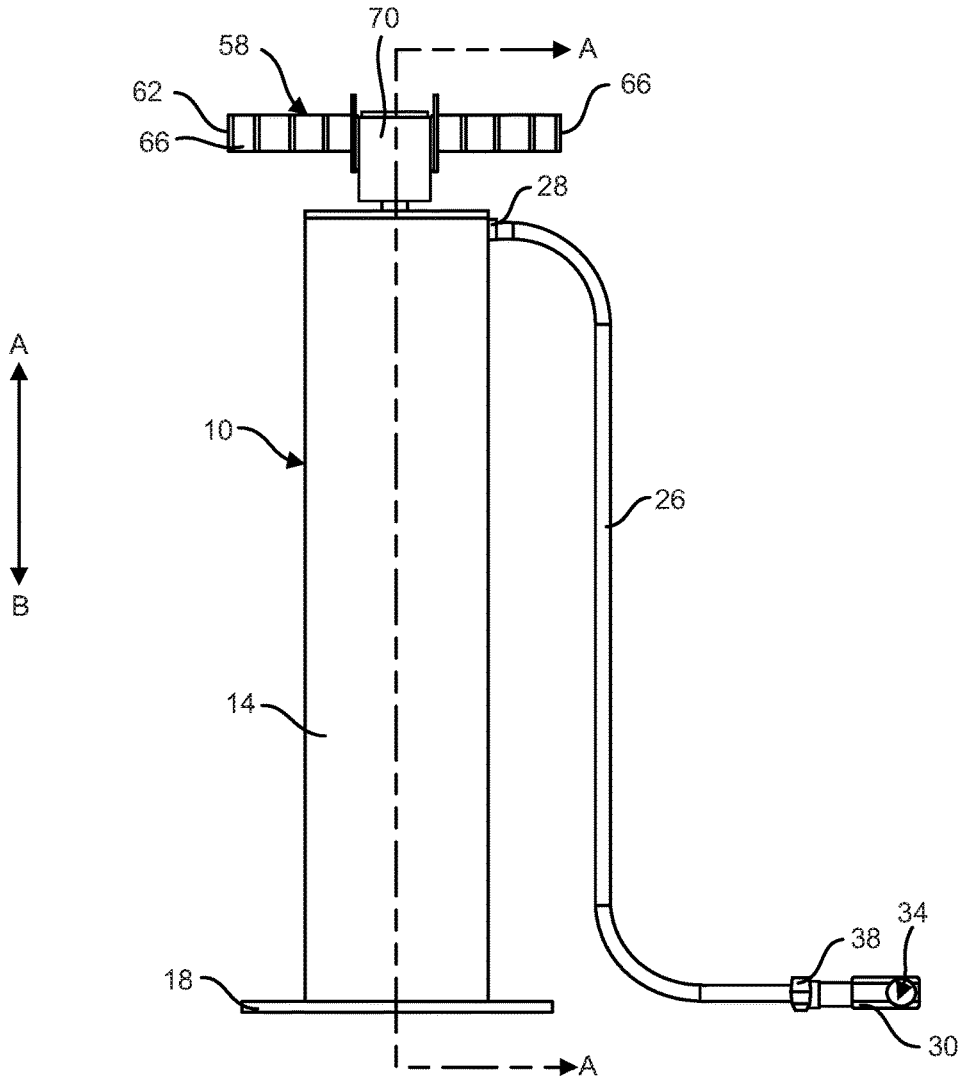
FIG. 2 illustrates a side view of the pump of FIG. 1.

FIGS. 1 and 2 illustrate a bicycle pump 10 according to an embodiment of the invention. The pump 10 includes a cylindrical body 14 connected to a circular base 18. The body 14 is open at the bottom end. The pump 10 includes a transparent circular top portion 22 detachably mounted on the top of the body 14 by connectors 16 such as tamper resistant bolts. Alternatively only a portion of the top portion 22 may be transparent and the remainder may be opaque. The base 18 includes holes 42 that are configured to receive anchors or other connectors to secure the pump 10 to the ground or floor. Underneath the transparent top portion 22 is a circular plate 24 that includes a hole 46 in which is positioned an air pressure gauge 50. A gasket 54 is positioned between the gauge 50 and the plate 24 along the hole 46 to form a seal between the gauge 50 and plate 24. A user can see the gauge 50 through the transparent top portion 22. By way of example only, the gauge 50 shows pressure in pounds per square inch. By way of example only, the body 14 and base 18 may be made of steel, aluminum, or some other metal, the top portion 22 may be made of polycarbonate, and the top plate 24 may be made of opaque aluminum or some other opaque material.

The pump 10 includes a handle assembly 58. The handle assembly 58 includes a handle bar 62 having two grips 66 attached thereto. The grips 66 can be slidably attached with adhesive to and removed from the handle bar 62 by maintenance staff. The handle bar 62 extends through, and is detachably connected to, a cylindrical handle cap 70. The handle bar 62 is detachably connected to the cap 70 by a tamper resistant fastener 74 such as a bolt or screw. The handle assembly 58 is shown in the "down" position wherein the cap 70 is pushed down to the top portion 22 of the pump 10. By way of example only, the handle bar 62 and handle cap 70 are both made of steel, aluminum, or some other metal, and the grips 66 are made of a hard polymer or rubber material.

A flexible hose 26 is connected to a first adapter 28 that extends from the body 14 of the pump 10 through a gap 36. A head 30 with a nozzle 34 is connected to the hose 26 by a second adaptor 38. By way of example only, the hose 26 may be 36 or 48 inches long and made of rubber covered with stainless steel braiding. The adapters 28 and 38 may be made of brass or another kind of metal. The nozzle 34 is configured to be used with a bicycle tire valve to fill the tire with air; however, the nozzle 34 can also be configured to fill other inflatable objects with air. The head 30 may be made of or include a magnetic material such that the head 30 can be magnetically connected to the metal pump body 14.

Figure 3:
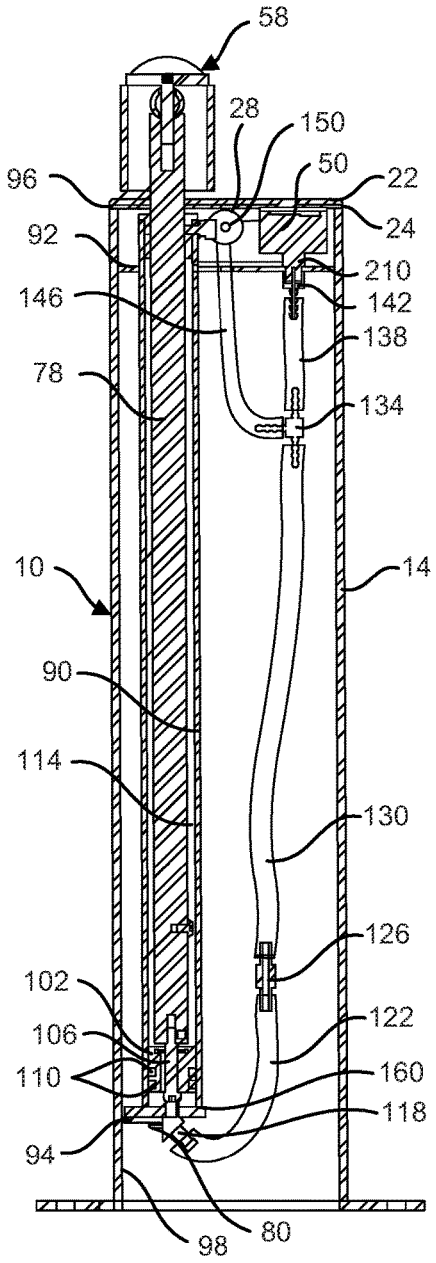
FIG. 3 illustrates a sectional side view of the pump of FIG. 1 taken along lines A-A.

FIG. 3 illustrates a sectional view of the pump 10 of FIG. 2 taken along lines A-A. The handle assembly 58 is connected to a cylindrical piston rod 78 that extends into the body 14 through holes 82 and 86 (FIG. 4) in the top portion 22 and the top plate 24, respectively. The rod 78 is received in a cylindrical tube 90. The tube 90 is secured in the body 14 by a top plate 92 and bottom plate 94 that extend from an interior wall 98 of the body 14. The tube 90 includes a base plate 160 that is detachably connected to the bottom plate 94 by a fastener 80. The fastener 80 can be a screw and washer assembly. The tube 90 includes a bushing 96 at the top end thereof that slidably receives the rod 78. A piston 102 is connected to the bottom of the rod 78 by a screw 106. The piston 102 has two gaskets or O-rings 110 mounted thereto. The piston 102 and the O-rings 110 form an air seal with the interior wall 114 of the tube 90. The outer diameter of the rod 78 is less than the inner diameter 90 of the tube 90 so that there is an air gap between the rod 78 and the tube 90 beneath the bushing 96 and above the piston 102. By way of example only, the rod 78 and tube 90 are made of steel or aluminum or some other metal, the bushing 96 and piston 102 are made of a hard polymer or plastic material, and the gaskets 110 are made of a flexible polymer or rubber material. If one of the gaskets 110 breaks or wears, it does not immediately need to be replaced because the second gasket 110 maintains a seal with interior wall 114 of the tube.

A barbed fitting 118 extends from the bottom of the tube 90. A first air line 122 extends from the fitting 118 to a check valve 126 that extends from the interior wall 98 of the body 14. A second air line 130 extends from the check valve 126 to a three way barbed fitting 134 that extends from the interior wall 98 of the body 14. A third air line 138 extends from the three way barbed fitting 134 to a barbed fitting 142 connected to the pressure gauge 50, which is mounted to the top plate 92. A fourth air line 146 extends from the three way barbed fitting 134 to a barbed fitting 150 that is connected to the first adapter 28. The air lines 122, 130, 138, and 146 may be made of rubber, and the fittings 118, 134, 142, and 150 may be made of steel or aluminum or some other metal.

Figure 4:
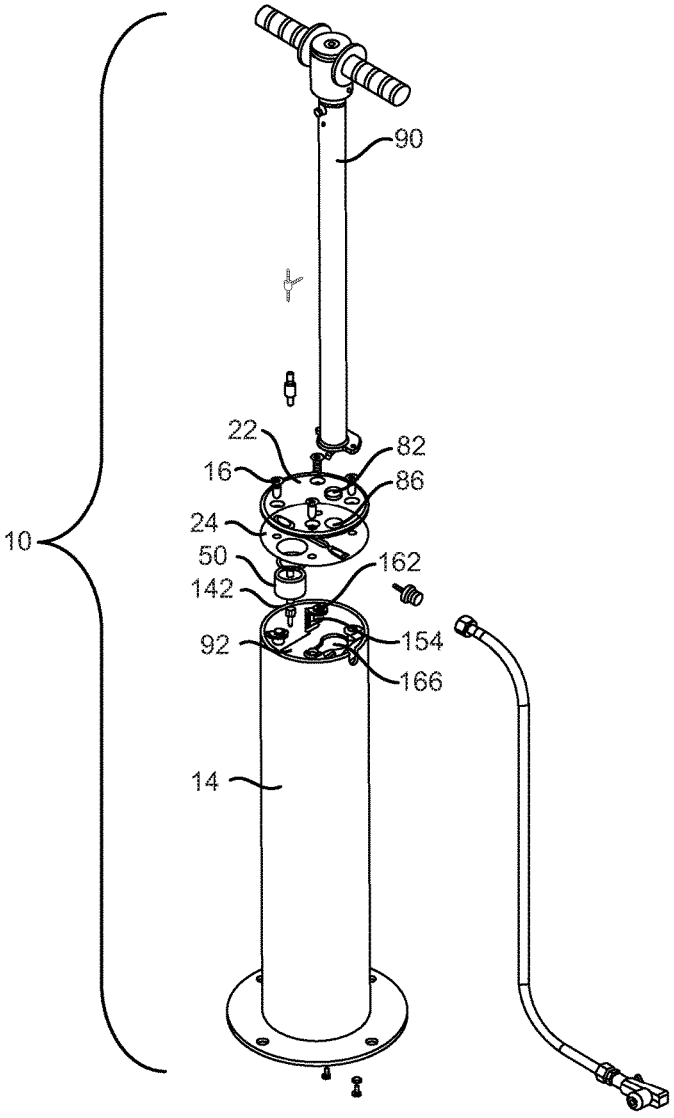
FIG. 4 illustrates a partially exploded isometric view of the bicycle pump of FIG. 1.

FIG. 4 illustrates a partially exploded isometric view of the pump 10. The rod 78 (FIG. 3) is positioned in the tube 90, and the tube 90 is removed from the body 14. The top plate 92 of the body 14 has four arms 154 that have holes that are configured to receive rivet nuts 162. The rivet nuts 162 receive the bolts 16 that extend through the top portion 22 and top plate 24 such that the top portion 22 and top plate 24 can be secured to the top plate 92 of the body 14. The top portion 22 and top plate 24 include holes 82 and 86 that receive the rod 78.

The top plate 92 also includes a hole 166 that receives the tube 90 when the tube 90 is placed in the body 14. The top plate 92 also supports the pressure gauge 50, which is connected to the barbed fitting 142 that is connected to the third air line 138 (FIG. 3). The pressure gauge 50 may be filled with oil so that the gauge 50 does not fog up in certain kinds of weather. In particular, the gauge 50 includes a chamber defined by a face and cover, and the chamber is filled at least partly with oil.

Figure 5:
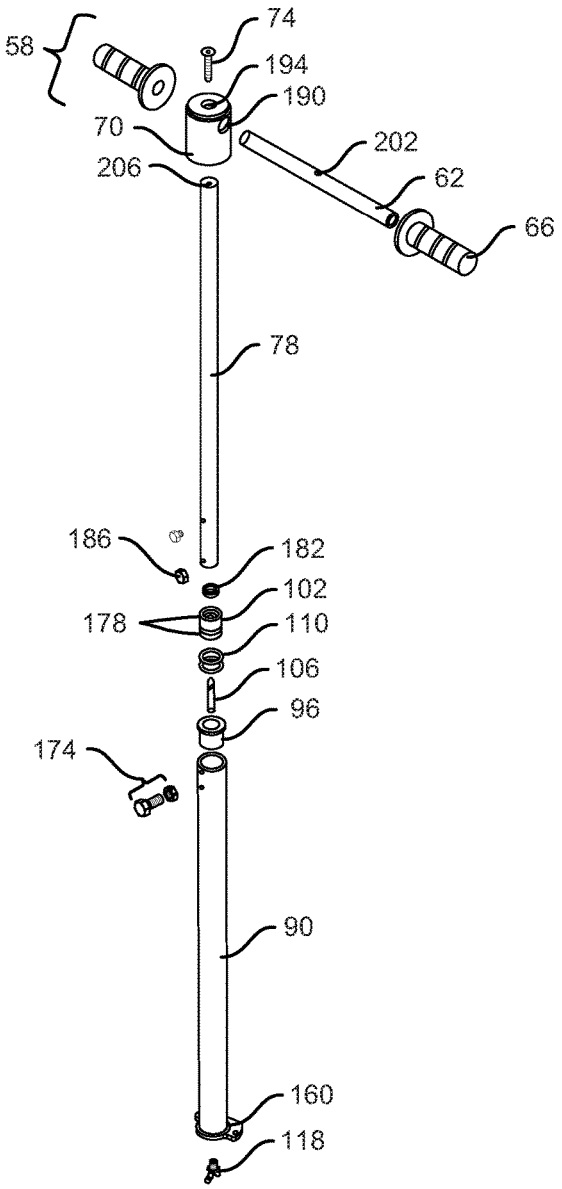
FIG. 5 illustrates an exploded isometric view of parts of the pump of FIG. 1.

FIG. 5 illustrates an exploded view of piston 78, tube 90, and handle assembly 58. The tube 90 includes a base plate 160 that can be connected to the bottom plate 94 (FIG. 3) of the body 14. The bushing 96 is connected to the tube 90 by a screw and washer assembly 174. The barbed fitting 118 is configured to be connected to the bottom of the tube 90.

With respect to the piston rod 78, the piston 102 has grooves 178 on the circumference thereof to receive the gaskets 110. Silicone grease may be applied to the gaskets 110 once the gaskets 110 are attached to piston 102. Another O-ring 182 is placed between the piston 102 and the rod 78 when the piston 102 is connected to the rod 78 to form a seal between the piston 102 and rod 78. The piston 102 is secured to the rod 78 by the shoulder screw 106, which is secured by a set screw 186 that extends through the body of the rod 78.

With respect to the handle assembly 58, the cap 70 includes horizontal holes 190 for receiving the handle bar 62 and a vertical hole 194 for receiving the screw 74. The handle bar 62 also includes a vertical hole 202, and the rod 78 includes a threaded bore 206 hole.

With reference to FIGS. 3, 4, and 5, the pump 10 is assembled as follows. The cylindrical body 14 includes the top and bottom plates 92 and 94, which are secured, such as by welding, to the interior wall 98 thereof. The barbed fitting 118 is attached to the tube 90, and the tube 90 is inserted into the body 14 from the bottom end such that a portion of the tube 90 is received in the hole 166 of the top plate 92 and the base plate 160 of the tube 90 is secured to the bottom plate 94 of the body 14 by the fastener 80. The gauge 50 is mounted on the top plate 92. The gauge 50 includes a lower portion 210 (FIG. 3) that extends through a hole in the top plate 92 into the interior of the body 14. By way of example only, the lower portion 210 of the gauge 50 can be threadably connected to the top plate 92, and Teflon tape can be applied to the threads of the lower portion 210. Alternatively, the gauge 50 can be mounted to the top plate 92 in any number of other ways as well. The barbed fitting 142 is connected to the lower portion 210 of the gauge 50.

The third air line 138 is connected to the barbed fitting 142 and the three way barbed fitting 134, and the fourth air line 146 is connected to the three way barbed fitting 134 and the barbed fitting 150. The second air line 130 is connected to the check valve 126 and the three way barbed fitting 134, and the first air line 122 is connected to the barbed fitting 118 and the check valve 126. Sealant and/or hose clamps may be used to attach the air lines to the barbed fittings. The hose 26 is threadably connected to the head 30 by the adapter 38, and the adapter 28 of the hose 26 is threadably connected to the barbed fitting 150 in the body 14. The adapter 38 can extend through the gap 36 into the body 14 of the pump 10 so that a person cannot reach the adapter 38 to unscrew it from the barbed fitting 150. Sealant may be used to threadably connect the adapters 28 and 38 to the hose 26.

The piston rod 78 with the piston 102 attached thereto is inserted into the tube 90 and then the bushing 96 is slid down along the piston rod 78 until the bushing 96 is positioned inside of and on top of the tube 90. The bushing 96 is then secured to the tube 90 by the screw and washer assembly 174. The gasket 54 is positioned on the gauge 50, and the top portion 22 and top plate 24 are then secured to the top plate 92 by the connectors 16.

The handle assembly 58 is assembled by inserting the handle bar 62 through the horizontal holes 190 in the cap 70 such that the hole 202 in the handle bar 62 is vertically aligned with the hole 194 in the cap 70. The screw 74 is inserted into the aligned holes 194 and 202 and then the cap is positioned on the rod 78 such the screw 74 can be threaded into the bore hole 206 of the rod 78 to fasten the cap 70 to the rod 78. The grips 66 are then slid on to the handle bar 62 and held in place on the handle bar 62 by glue or other adhesive.

Once the pump 10 is assembled, the pump 10 can be secured to a ground or floor surface by anchors, such as bolts, that are inserted through the holes 42 of the base 18 into the ground. By way of example only, the pump 10 can be secured to the ground at a park, bike station, or store or along a trail.

With respect to FIGS. 1-3, the bicycle pump 10 operates as follows. A bicyclist uses the pump 10 by placing the nozzle 34 of the pump 10 on the valve of his or her bicycle tire. Air is released from the bicycle tire valve into the hose 26 of the pump 10. The air travels from the hose 26 into the fourth airline 146 and to the three way barbed fitting 134. The flow of the air then splits into two different paths. The air travels through the second air line 130 to the check valve 126, which prevents the air from flowing into the first air line 122. The air also travels through the third air line 138 to the pressure gauge 50, at which point the air can no longer travel any further. At this point, the flow of air from the bicycle tire to the pump 10 has reached a point of equilibrium, and the air gauge 50 displays the pressure of the air at that equilibrium point. While the gauge 50 shows the air pressure of a system including the hose 26, the second, third, and fourth air lines, 130, 138, and 146, and the bicycle tire, the amount of air in the hose 26 and air lines 130, 138, and 146 is relatively small compared to the amount of air in the bicycle tire. Therefore, the gauge 50 provides a reasonably good indication of the air pressure of the bicycle tire. If the air pressure shown by the gauge 50 is lower than what is desirable for bicycle tire, the bicyclist uses the pump 10 to fill the tire with more air.

In particular, the bicyclist places at least one hand on the grips 66 of the handle assembly 58 and moves the piston rod 78 up and down in the direction of Arrows A and B (FIG. 2). As the piston rod 78 is pulled upward in the direction of Arrow A, air is drawn into the tube 90 beneath the piston 102 through an inlet (not shown) in the tube 90. The bushing 96 is positioned to engage the top of the piston 102 to prevent the rod 78 from being pulled out of the tube 90. As the piston rod 78 is pushed downward in the direction of Arrow B toward the base plate 160 of the tube 90, the piston 102, which forms a seal with the interior of the tube 90, displaces air out of the tube 90 through the barbed fitting 118 and into the first air line 122.

The displaced air then travels through the first air line 122 and the check valve 126 into the second air line 130. Once the air has passed through the check valve 126, the air cannot go back through the check valve 126 into the first air line 122. Therefore, the air pressure in the second, third, and fourth air lines 130, 138, and 146 increases and, because the air cannot go back through the check valve 126 or through the gauge 50, the air travels through the fourth air line 146 into the hose 26 and into the bicycle tire. The air pressure in the bicycle tire increases, as does the pressure in the second, third, and fourth air lines 130, 138, and 146, and this increase in air pressure is shown by the gauge 50. The user continues to move the piston rod 78 up and down in this manner until the gauge 50 shows that the pressure in the system, and thus the tire, has reached a desirable level. The user then disengages the nozzle 34 form the bicycle tire valve and magnetically connects the head 30 to the body 14 of the pump 10.

Figure 6:
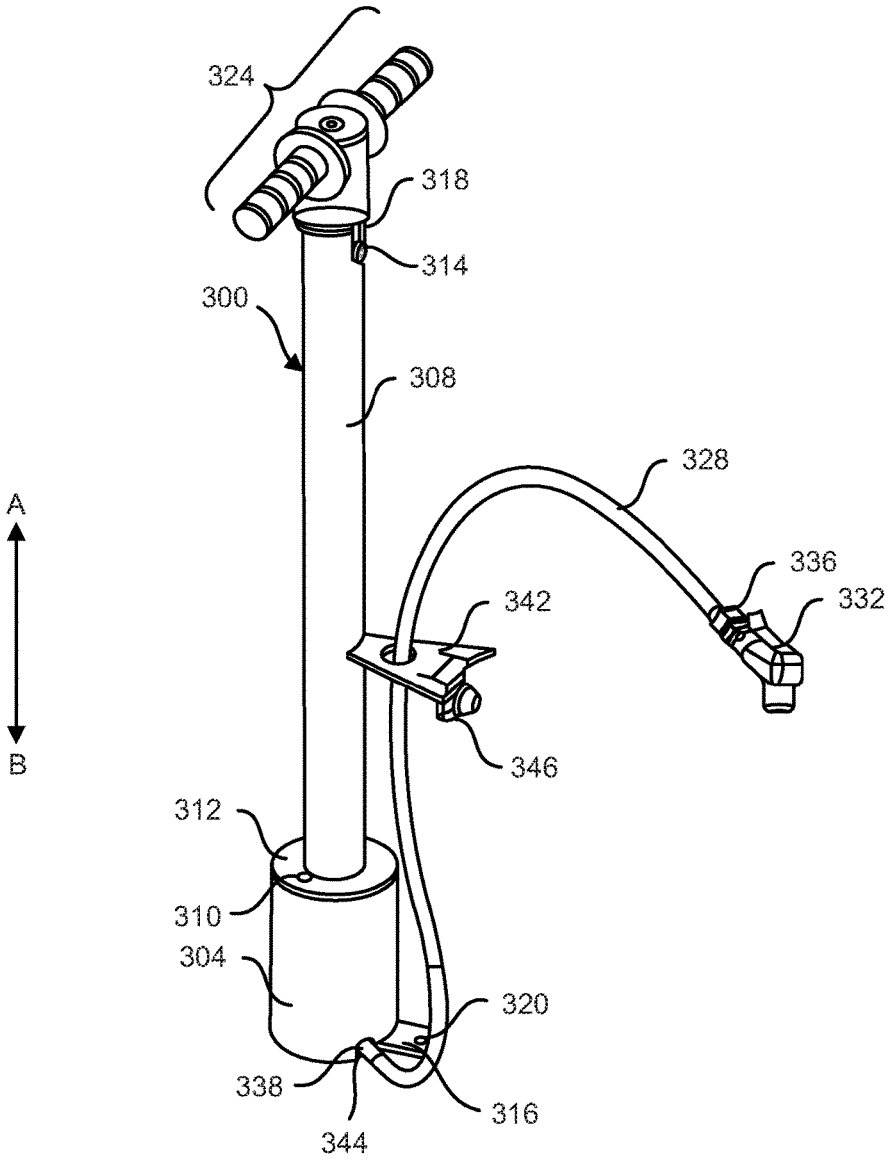
FIG. 6 illustrates an isometric view of a pump according to an embodiment of the present invention.
Figure 7:
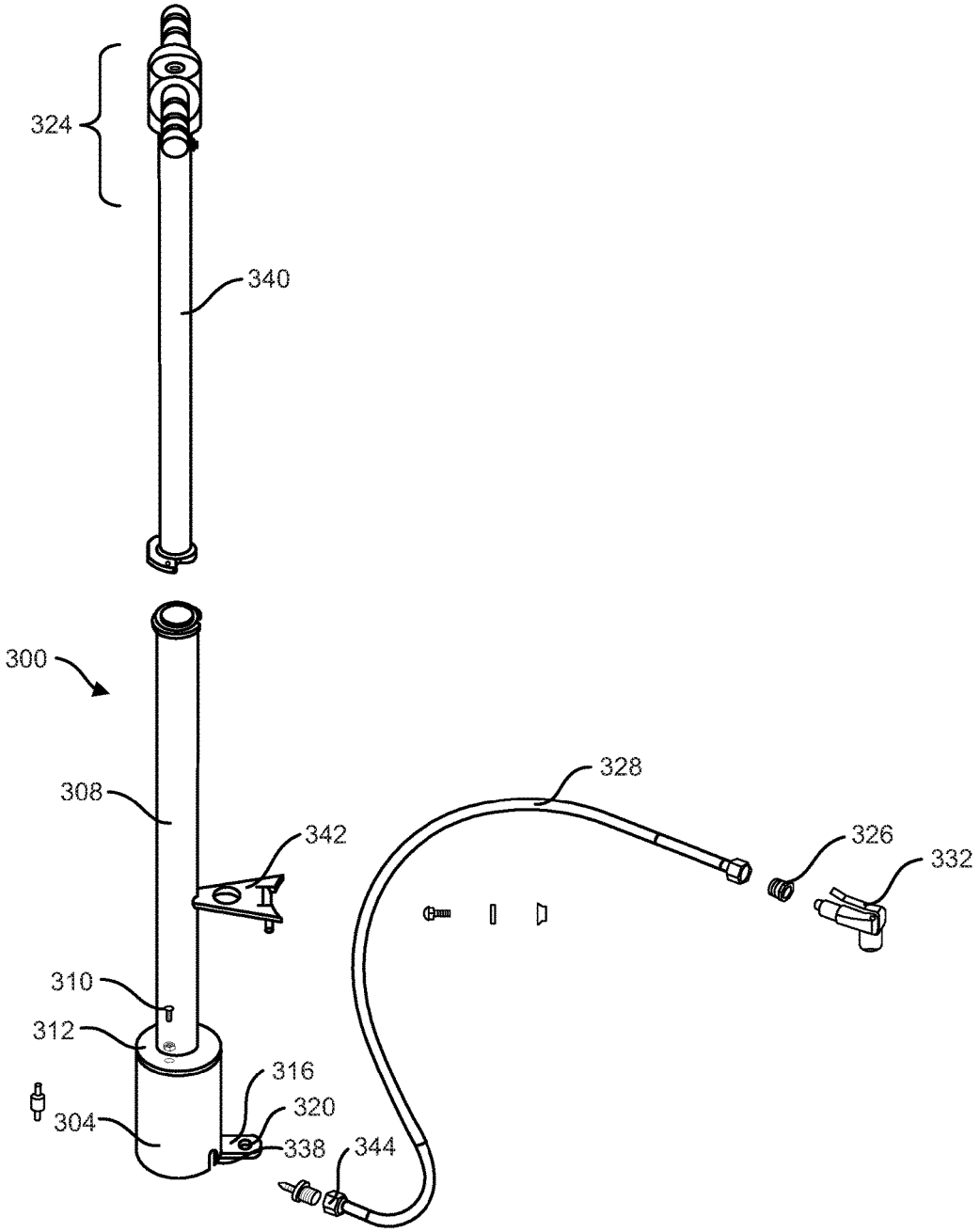
FIG. 7 illustrates a partially exploded isometric view of the pump of FIG. 6.

FIG. 6 illustrates an isometric view of a pump 300 according to an alternative embodiment of the present invention, and FIG. 7 illustrates a partially exploded isometric view of the pump 300 of FIG. 6. The pump 300 operates in much the same way as pump 10 shown in FIGS. 1-5, but does not include an air pressure gauge and therefore is smaller and has fewer parts. The pump 300 includes a cylindrical lower body 304 and cylindrical upper body 308. The upper body 308 is connected to a circular plate 312 that is detachably connected to the lower body 304 by tamper resistant fasteners 310. The lower body 304 includes a tab 316 that has a hole 320 configured to receive an anchor or connector (not shown) that secures the tab 316 to the base plate of a bicycle repair stand, such as a Dero Fixit bicycle repair stand. The upper body 308 includes a tab 342 that has a hole 346 configured to receive a bolt with a washer and tamper resistant nut that secures the tab 342 to the side of a bike repair stand, such as a Dero Fixit bicycle repair stand. The lower body 304 is open at the bottom. The pump 300 includes a handle assembly 324 that is similar to the handle assembly 58 shown in FIG. 1. The pump 300 also includes a hose 328 and head 332 that are similar to those shown in FIG. 1. The hose 328 is connected to the head 332 by a first adapter 336 and to the lower body 304 by a second adapter 344 that extends from a gap 338 in the lower body 304. The hose 328 extends through the tab 342. The head 332 may be magnetized such that the head 332 can be magnetically secured to the metal upper body 308.

The pump 300 has a tube 340 that is similar to the tube 90 of FIG. 3. The tube 340 is configured to be slidably received in the upper body 308. The tube 340 slidably receives a piston rod assembly (not shown) similar to that of the pump 10 shown in FIG. 5. The tube 340 includes a bushing similar to the bushing 96 shown in FIG. 5 that is detachably connected to the tube 340 by a tamperproof fastener 314. The fastener 314 can be a screw and washer assembly. The fastener 314 is positioned in and accessible through a gap 318 in the upper body 308.

Figure 8:
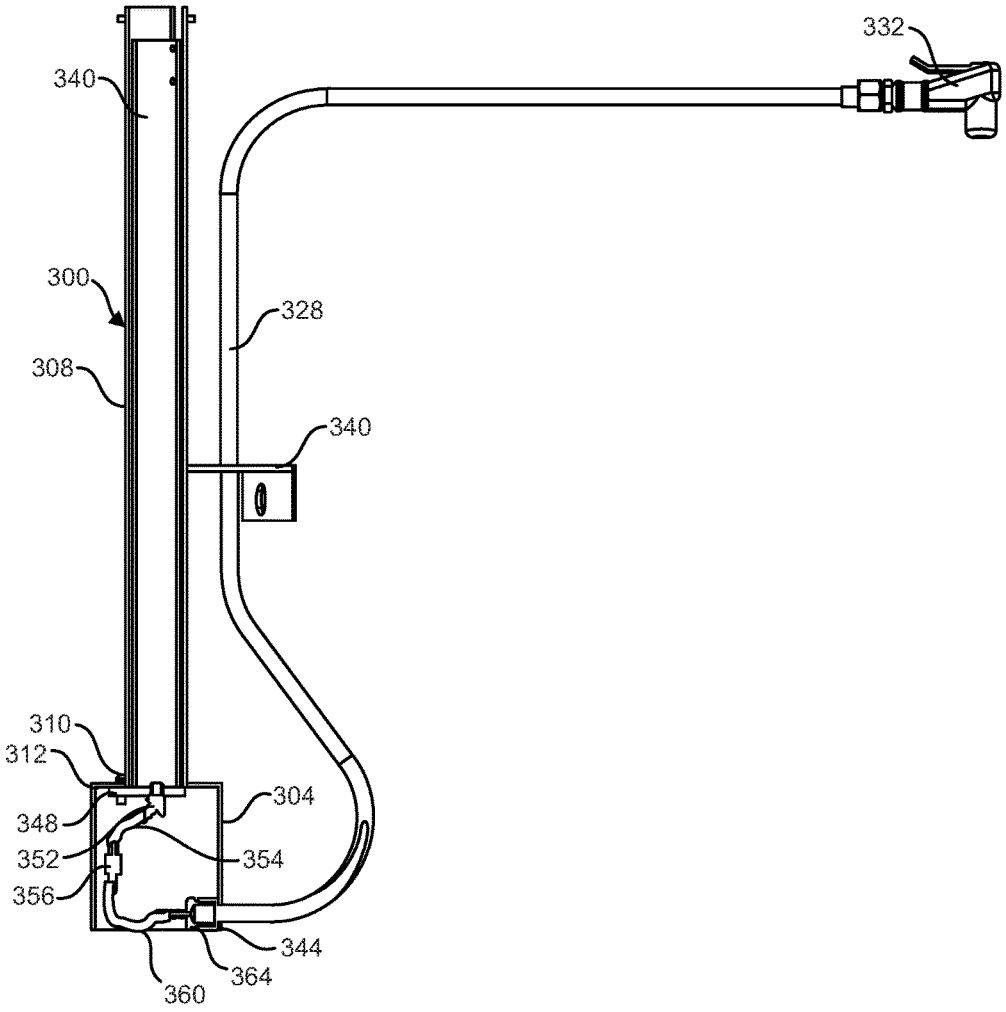
FIG. 8 illustrates a sectional side view of a portion of the pump of FIG. 6.

FIG. 8 illustrates a sectional side view of a portion of the pump 300. The tube 340 has a base plate 348 that is detachably secured to the plate 312 by the fastener 310. A first barbed fitting 352 extends from the base plate 348 of the tube 340. A first air line 354 extends from the barbed fitting 352 to a check valve 356, and a second airline 360 extends from the check valve 356 to a second barbed fitting 364. The second adapter 344 is connected to the second barbed fitting 364 and extends out of the gap 338 (FIG. 6) of the lower body 304 and is connected to the hose 328. The hose 328 extends through the hose holder tab 342.

With reference to FIGS. 6-8, the pump 300 is assembled as follows. The tube 340 is inserted into the lower and upper bodies 304 and 308 of the pump 300 through the open bottom of the lower body 304. The base plate 348 of the tube 340 is secured to the plate 312 by the fastener 310. The first air line 354 is connected to the first barbed fitting 352 and the check valve 356 with sealant. The second air line 360 is connected to the check valve 356 and the second barbed fitting 364 with sealant. The head 332 is connected to the first adapter 336 of the hose 328, and the second adapter 344 of the hose 328 is connected to the second barbed fitting 364 and positioned in the gap 338 of the lower body 304. The adapter 344 can extend through the gap 338 into the lower body 304 of the pump 300 so that a person cannot reach the adapter 344 to unscrew it from the barbed fitting 364. Sealant may be used to threadably connect the adapters 336 and 344 to the hose 328, barbed fitting 364, and head 332.

In operation, a bicyclist connects the head 332 of the pump 300 to the valve of a bike tire. The bicyclist then uses at least one hand to grip the handle assembly 324 and move the handle assembly 324 up and down in the direction of Arrows A and B. As the bicyclist pulls the handle assembly 324 up in the direction of Arrow A, air is drawn into the tube 340 below the piston (FIG. 3) through an inlet in the tube (not shown). As the bicyclist pushes the handle assembly 324 down in the direction of Arrow B, the piston pushes air down out of the tube 340 through the first barbed fitting 352 into the first air line 354. The air travels from the first air line 354 through the check valve 356 into the second air line 360. The air then moves from the second air line 360 through the second barbed fitting 364 and second adapter 344 into the hose 328. The air passes through the hose 328 and the head 332 into the bicycle tire. The bicyclist continues operating the pump in this manner until the air pressure of the bicycle tire has reached a desirable level.

Figure 9:
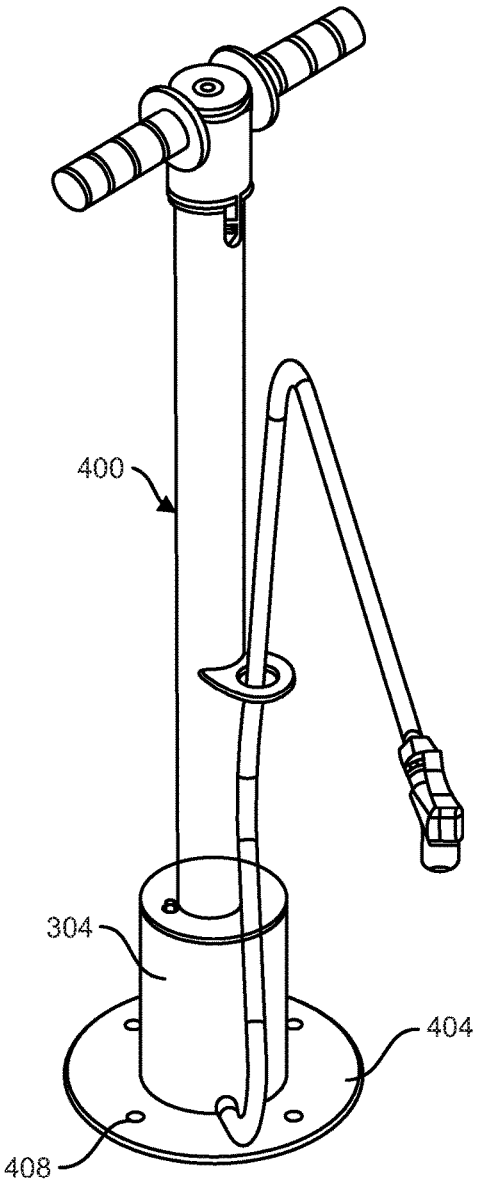
FIG. 9 illustrates an isometric view of a pump according to an embodiment of the present invention.
Figure 10:
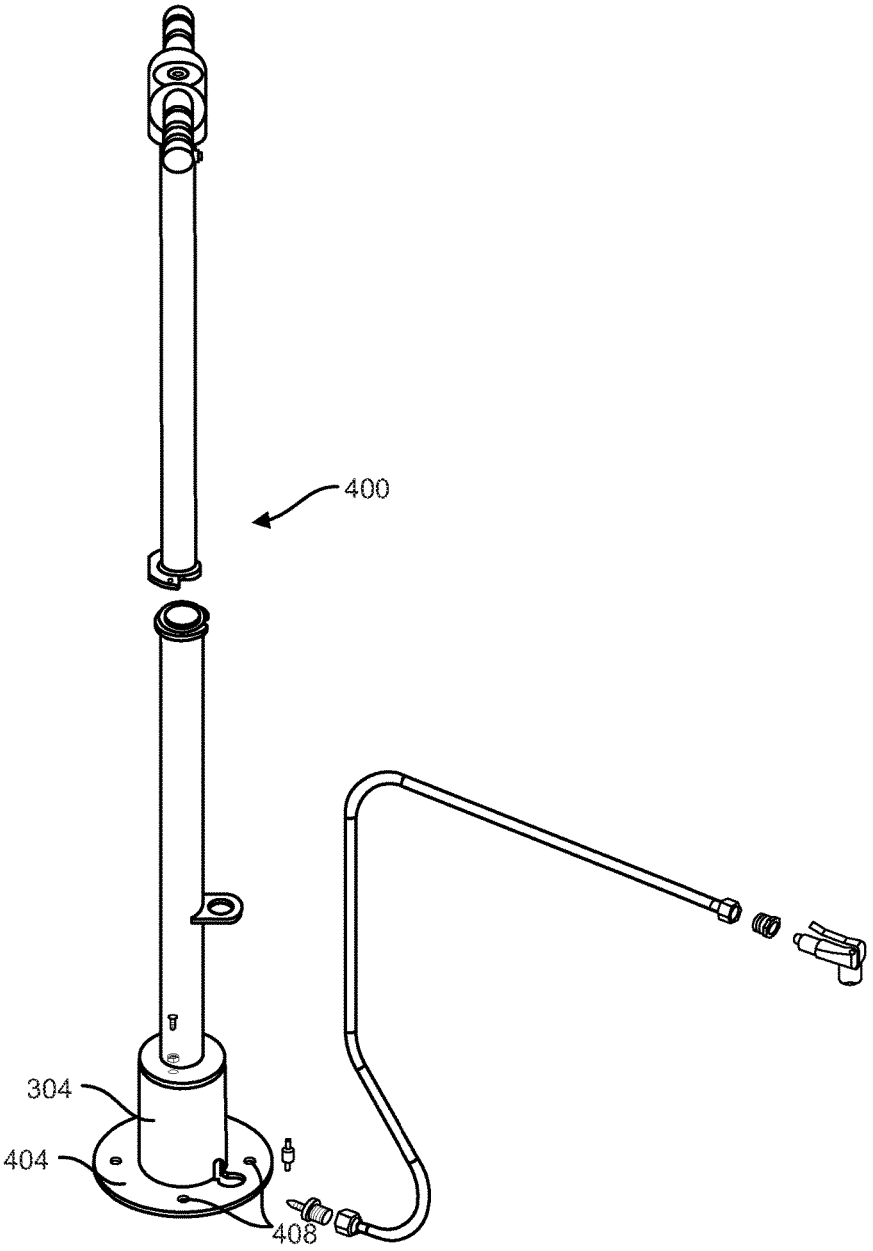
FIG. 10 illustrates a partially exploded isometric view of the pump of FIG. 9.

FIG. 9 illustrates an isometric view of a pump 400 according to an alternative embodiment of the present invention, and FIG. 10 illustrates a partially exploded isometric view of the pump 400 of FIG. 9. The pump 400 operates in much the same way as pump 300 shown in FIGS. 6-8. The main difference between pump 400 and pump 300 is that pump 400 includes a larger base plate 404 attached to the lower body 304 of the pump. The base plate 404 is circular and extends around the entire perimeter of the lower body 304. The base plate 404 includes multiple holes 408 that are configured to receive fasteners or anchors (not shown) that secure the pump 400 to a ground surface. In this way, the pump 400 is securely fastened to the ground surface while the pump 300 is fastened to a bicycle repair stand.

The various pump embodiments 10, 300, and 400 may be configured to be used to inflate any number of other inflatable objects besides bicycle tires and can be used in any number of different locations. The pump embodiments of the present invention are made of robust and durable materials and components that provide for greater component lifespans even though the pumps are located outside and are exposed to the elements and repeated use by numerous different bicyclists. For example, many of the components are made of steel or aluminum and the hose includes metal braiding and is threadably connected to metal adapters to prevent the hose from easily being detached or damaged. Moreover, the pumps are easy to disassemble, and many of the components are removable. Therefore, if an individual component does wear out or break, the component can easily be removed and replaced without the need to replace the entire pump. For example, the hose, air lines, handle, and air gauge can all easily be removed and replaced by maintenance staff with special tools for tamper resistant hardware. The pumps may also include user friendly features such as an oil-filled pressure gauge that does not fog up and a pump head that can be magnetically connected to the pump body.

While various spatial and directional terms, such as top, bottom, lower, mid, lateral, horizontal, vertical, front and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A pump for inflating tires with air, comprising:

a body having an upper portion and a lower portion and a circular plate located between the upper portion and lower portion, wherein the lower portion includes a first base plate that has a hole configured to receive an anchor to secure said first base plate to the ground, said lower portion having a greater outer diameter than said upper portion;

a handle assembly including a piston-rod combination, handle bar, and handle cap detachably connected to each other by a first fastener;

a tube positioned in said upper portion of said body and including a second base plate positioned beneath said circular plate that is detachably connected to said circular plate by a second fastener, said tube receiving said piston-rod combination such that said piston-rod combination slides in said tube;

an air line positioned in said lower portion of said body, said air line being connected to said tube at one end and connected to an adapter at another end; and a hose threadably connected to said adapter and extending from said lower portion of said body, said hose having a head configured to engage a nozzle of a tire;

wherein, when said piston-rod combination is moved downward within said tube, air is displaced from said tube and through said air line to said hose such that said head dispenses air.

2. The pump of claim 1, wherein a portion of said hose is made of threaded metal.

3. The pump of claim 1, wherein said piston-rod combination includes a piston head on which are mounted two flexible gaskets that each form a seal with an interior wall of said tube.

4. The pump of claim 1, wherein said body, handle bar, piston-rod combination, and tube are each made of either steel or aluminum.

5. The pump of claim 1, wherein said head magnetically connects to said body.

6. The pump of claim 1, wherein said air line comprises (a) a first air line portion that is connected at a first end to a barbed fitting extending from said tube and that is connected at a second end to a check valve and (b) a second air line portion that is connected at another first end to said check valve and that is connected at another second end to said adaptor.

7. The pump of claim 1, wherein the upper portion includes a tab that has a hole configured to receive a fastener that secures the tab to another structure.

8. The pump of claim 1, wherein the upper portion and lower portion are both cylindrical and the lower portion has a greater diameter than the upper portion.

9. The pump of claim 8, wherein the circular plate has a greater diameter than the upper portion.

10. The pump of claim 6, wherein the barbed fitting extends from the second base plate.

* * * * *